US010220233B2

(12) United States Patent
Schmidt et al.

(10) Patent No.: US 10,220,233 B2
(45) Date of Patent: Mar. 5, 2019

(54) MOBILE HIP SQUAT APPARATUS

(71) Applicant: USA Strength and Performance, LLC, Greenback, TN (US)

(72) Inventors: Bryan Schmidt, Greenback, TN (US); Steve Schmidt, Greenback, TN (US); Jason Murrell, Knoxville, TN (US); Marty Mitchell, Vonore, TN (US)

(73) Assignee: USA Strength and Performance LLC, Greenback, TN (US)

( * ) Notice: Subject to any disclaimer, the term of this patent is extended or adjusted under 35 U.S.C. 154(b) by 0 days.

(21) Appl. No.: 15/498,105

(22) Filed: Apr. 26, 2017

(65) Prior Publication Data

US 2018/0311522 A1 Nov. 1, 2018

(51) Int. Cl.
*A63B 21/00* (2006.01)
*A63B 21/06* (2006.01)
(Continued)

(52) U.S. Cl.
CPC .... *A63B 21/0004* (2013.01); *A63B 21/00065* (2013.01); *A63B 21/06* (2013.01);
(Continued)

(58) Field of Classification Search
CPC ..... A63B 21/0004; A63B 21/00058; A63B 21/00061; A63B 21/00065; A63B 21/06; A63B 21/0615; A63B 21/0616; A63B 21/0617; A63B 21/062; A63B 21/0622; A63B 21/0624; A63B 21/0626; A63B 21/0628; A63B 21/063; A63B 21/0632; A63B 21/065; A63B 21/068; A63B 21/08; A63B 21/15; A63B 21/159; A63B 21/22; A63B 21/4009; A63B 21/4025; A63B 21/4027; A63B 21/4033; A63B 21/4035; A63B 21/4045; A63B 21/4047; A63B 21/4049; A63B 22/0046; A63B 22/0048;
(Continued)

(56) References Cited

U.S. PATENT DOCUMENTS 3,804,410 A * 4/1974 Gilman ..... A63B 69/345 473/445
4,236,723 A 12/1980 Lemmon
(Continued)

OTHER PUBLICATIONS

Hip Belt Squats Using T-Bar Row (landmine), Bodybuilding.com Forums, http://forum.bodybuilding.com, Accessed Mar. 26, 2017.
(Continued)

*Primary Examiner* — Gary D Urbiel Goldner
(74) *Attorney, Agent, or Firm* — Chambliss, Bahner & Stophel, P.C.

(57) ABSTRACT

A mobile exercise device having a front wheel connected via a front wheel mount to a weight carriage that extends rearwardly from the front wheel mount. A weight loading member is mounted to the weight carriage and is operable to receive exercise weights and to support the exercise weights so that the exercise weights move as the weight carriage moves. A user engagement member includes a first end for engaging hips of a user and a second end for connecting to the weight carriage. Lifting the weight carriage via the user engagement member causes the weight loading member to be lifted and to rotate with respect to the front wheel.

19 Claims, 9 Drawing Sheets

(51) Int. Cl.
*A63B 22/20* (2006.01)
*A63B 23/04* (2006.01)

(52) U.S. Cl.
CPC ..... *A63B 21/4009* (2015.10); *A63B 21/4035* (2015.10); *A63B 22/20* (2013.01); *A63B 23/0405* (2013.01); *A63B 2023/0411* (2013.01)

(58) Field of Classification Search
CPC . A63B 22/20; A63B 23/035; A63B 23/03516; A63B 23/03525; A63B 23/04; A63B 23/0405; A63B 23/047; A63B 23/0482; A63B 23/0494; A63B 2023/0411; A63B 2208/0223; A63B 2210/00; A63B 2210/50; A63B 2244/09; A63B 69/34; A63B 69/345
See application file for complete search history.

(56) References Cited

U.S. PATENT DOCUMENTS 4,344,619 A 8/1982 Szabo
4,657,245 A 4/1987 Smith
4,674,160 A 6/1987 Gibson
5,310,393 A 5/1994 Highsmith et al.
5,328,192 A 7/1994 Thompson
5,487,712 A * 1/1996 Kann ..... A63B 21/0615 482/148
5,813,951 A * 9/1998 Einsig ..... A63B 21/06 482/1
7,484,737 B2 * 2/2009 Satorius ..... A45F 3/14 280/1.5
7,549,648 B2 6/2009 Girard et al.
7,608,020 B2 * 10/2009 Mason ..... A63B 21/0615 482/105
7,955,223 B1 * 6/2011 Gilman ..... A63B 21/0615 280/15
8,147,389 B1 * 4/2012 Hoole ..... A63B 23/1227 482/100
8,328,664 B2 * 12/2012 Krause ..... A63B 21/0618 473/438
8,360,938 B2 * 1/2013 Gilman ..... A63B 21/0615 482/51
8,695,992 B2 4/2014 Piaget et al.
8,734,305 B1 * 5/2014 Hoole ..... A63B 23/1218 482/105
8,858,405 B2 * 10/2014 Agate ..... A63B 21/0618 482/106
9,017,189 B2 * 4/2015 Leath ..... A63B 21/012 473/422
9,192,803 B2 * 11/2015 Cayo ..... A63B 21/0618
9,238,159 B2 * 1/2016 Engle, Jr. ..... A63B 21/0618
9,289,646 B2 * 3/2016 Tully ..... A63B 21/16
9,808,663 B2 * 11/2017 Chen ..... A63B 21/0626
9,821,186 B2 * 11/2017 Chen ..... A63B 21/062
2004/0150175 A1 8/2004 Cepull
2006/0237918 A1 10/2006 Satorius
2011/0165972 A1 * 7/2011 Forrest, Sr. ..... A63B 69/002 473/445
2014/0073491 A1 3/2014 Gilson
2014/0135184 A1 * 5/2014 Hoole ..... A63B 23/03525 482/97
2015/0297942 A1 * 10/2015 Tully ..... A63B 21/16 482/94
2017/0087400 A1 * 3/2017 Chen ..... A63B 21/062
2017/0087402 A1 * 3/2017 Chen ..... A63B 21/0626
2017/0189733 A1 * 7/2017 Bentley ..... A63B 21/06
2017/0203149 A1 * 7/2017 D'Amico ..... A63B 23/0405

OTHER PUBLICATIONS

Matt Wenning Belt Squat Machine, UK Gym Equipment, https://www.kustomkitgymequipment.com/belt-squat.html, Accessed Mar. 16, 2017.

* cited by examiner

MOBILE HIP SQUAT APPARATUS

FIELD

This disclosure relates to the field of exercise devices. More particularly, this disclosure relates to mobile machine that enables a user to carry out squat exercises and to reposition the device as desired.

BACKGROUND

Squat type exercises are useful for developing hip, abdominal, anterior and posterior chain strength. Often these exercises are carried out using weight-loaded barbells that are positioned onto a participant's back and shoulders. This loaded is often placed into a squat rack or other similar device. While beneficial for building strength, these traditional types of squat exercises and squat racks do not allow a user to move freely while carrying out exercises. Additionally, many participants are unable to use traditional squatting methods due to back, upper body or other types of injuries or physical limitations. Lastly, traditional squat racks are primarily intended for solo individuals and are not well suited for a team or multi-participant setting.

What is needed, therefore, is a training system that seeks to address each of the issues discussed above.

SUMMARY

The above and other needs are met by mobile exercise device system that includes two or more mobile exercise devices configured to removably mount together and to move forwards and backwards together as a unit when connected together.

Each mobile exercise device includes a front wheel connected to a weight carriage via a front wheel mount. In particular, a first end of the weight carriage is mounted to and extends rearwardly from the front wheel mount. The weight carriage includes an elongate stationary support and an elongate rotatable support vertically offset from and mounted to the stationary support. In particular, the front end of the rotatable support is rotatably connected to the front end of the stationary support and rotates about a center of rotation. A user can raise the back end of the elongate rotatable support and rotate it about the center of rotation between a down position and an up position. A rear wheel is connected to the back end of the stationary support via a rear wheel mount. A weight loading member is mounted to the weight carriage and is operable to receive exercise weights and to support the weights so that they and move as the weight carriage moves. The user raises the rotatable support via a user engagement member that engages the user's hips. The individual mobile exercise devices are connected together via a connection member. Each pair of adjacent exercise device has mounting brackets mounted to their elongate rotatable supports. The brackets are positioned to receive ends of the connection member, which are rotatably mounted to the mounting brackets.

Lifting the weight carriage via the user engagement member causes the weight loading member to be lifted and to rotate with respect to the center of rotation. The adjacent mobile exercise devices are kept in substantial front-to-back alignment with one another by the connection member. Additionally, the adjacent mobile exercise devices are vertically movable with respect to one another due to the rotatable connection between the connection member and the brackets.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
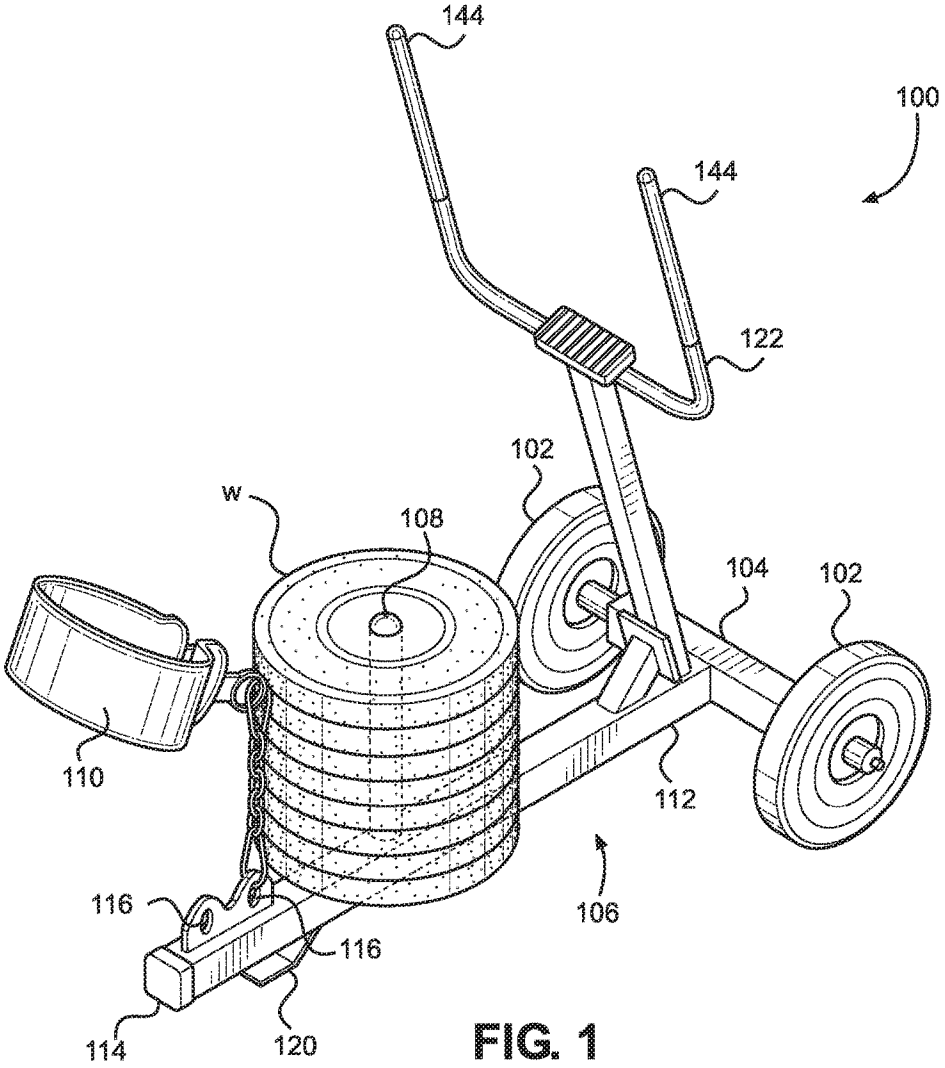
FIG. 1 is a perspective view of an exercise device according to a first embodiment of the present disclosure.

With initial reference to FIG. 1, there is provided a mobile exercise device 100 according to a first embodiment of the present disclosure. The exercise device includes generally a front wheel 102, a front wheel mount 104, a weight carriage 106, a weight loading member 108, and a user engagement member 110. Each component is discussed in more detailed below. As further discussed below, lifting at least a portion of the weight carriage 106 via the user engagement member 110 causes the weight loading member to be lifted and to rotate with respect to the front wheel 104 (i.e., the center of rotation). Exercise weights W may be loaded onto the weight loading member 108, such that moving the mobile exercise device 100 and lifting the weight carriage 106 provides strength training benefits.

The present disclosure relates generally to a wheeled exercise device that enables a user to lift weights via a hip strap 110. In this particular embodiment, a pair of front wheels 102 are rotatably mounted in parallel arrangement by the front wheel mount 104. However, in other embodiments, a single front wheel may be used or more than two front wheels may be used. The wheels 102 enable the user to move forwards and backwards while lifting the weights W. In some embodiments, the wheels 102 may also allow the user to move freely in a lateral direction. In other embodiments described below, the user may also move forwards and backwards without lifting weights W. In still further embodiments discussed below, multiple users may move together in unison while, optionally, lifting weights W mounted to each of their respective exercise devices 100.

The elongate weight carriage 106 has a first end 112 and a second end 114. The first end 112 is fixedly mounted to and extends rearwardly from the front wheel mount 104. The weight loading member 108 (e.g., plate horn) is mounted to the weight carriage is operable to receive exercise weights W and to support the weights so that they and move as the weight carriage moves. In this particular embodiment, the weight loading member 108 is a vertically-oriented post that extends upwards from a top surface of the weight carriage 106. The post 108 is sized to slide through a central opening formed in the weight plates. The weights W and the second end 114 of the weight carriage 106 are raised by connecting a user engagement member to a mounting location located near the second end of the weight carriage. The user engagement member 110 is a belt worn by the user, which includes a first end for engaging hips of a user and a second end for connecting to the weight carriage 106. The user engagement member 110 provides a single point connection between the user and the mobile exercise device 100 and allows the weight carriage 106 and the weights W to be lifted hands-free by the user. In this embodiment, the weight carriage 106 rotates on the wheels 102. The belt 110 may be mounted to one of several mounting locations 116 on the weight carriage 106. The multiple point connector accommodates for proper positioning of various user heights when connecting the hip-loaded engagement member. In the embodiment shown, forward and rearward mounting locations 116 are mounted to and extend upwards from a top surface of the weight carriage 106. A hook or carabiner 118 located at the second end of the user engagement member 110 is fixed at the selected mounting location. A lower strut 120, mounted to a bottom surface of the weight carriage 106, supports the weight carriage 106 in a slightly raised position such that the second end 114 is supported off of the ground.

Although the weight carriage 106 and weights W may be lifted hands-free by a user, as discussed above, the mobile exercise device 100 may also include a handlebar 122 as well. The handlebar 122 may be fixedly connected to the exercise device 100 or they may be removable. In this particular case, the handlebars 122 are attached to the weight carriage 106 by welds. The handlebar 122 includes a pair of spaced apart grasping ends 144 that may be grasped by a user for improved balance or to facilitate lifting the weights W and moving the exercise device forwards or backwards. The grasping ends 144 are joined together at their lower end and are mounted to a vertical post 145. The vertical post 145 is mounted to the top surface of the weight carriage 106 near the front end 112 behind the front wheel mount 104. A support bar 147 is fixedly mounted at an angle between the weight carriage 106 and the vertical post 145, and provides strength and rigidity to the handlebars 122.

Figure 6:
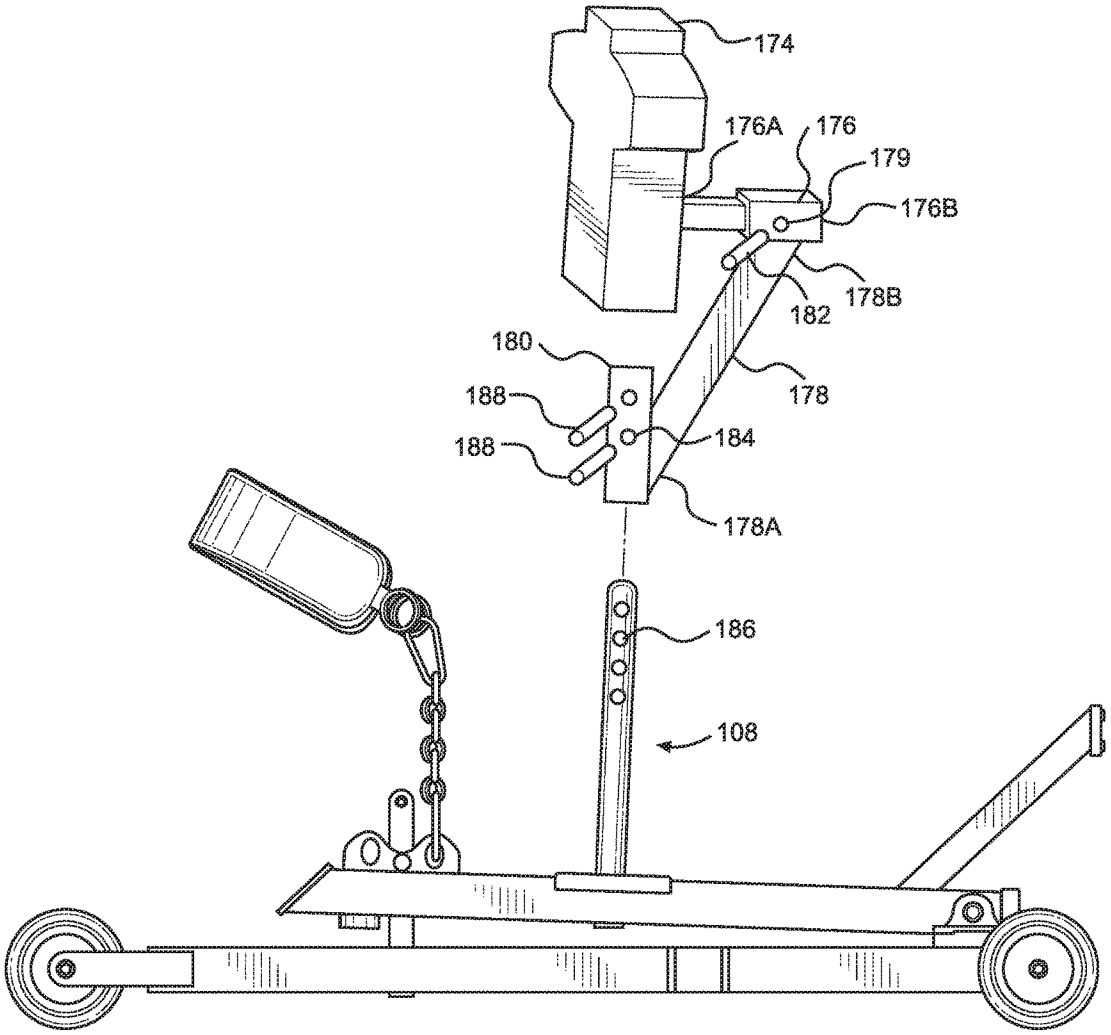
FIG. 6 depicts the exercise device of FIG. 3 further including an option accessory attachment.

In certain embodiments, the handlebar 122 may be replaced by other removable accessories. For example, FIG. 6 shows an accessory 174 removably mounted to the weight loading member 108. In this particular case, the accessory 174 is a punching bag. However, other accessories, such as a strike bag or swiss bar, could be mounted to the weight loading member 108 in place of the punching bag. The accessories are easily interchangeable with one another. The accessory is mounted at a front end 176A of a first mounting arm 176. The back end 176B of the first mounting arm 176, which is opposite the accessory 174, includes a lower opening that receives a top end 178B of a second mounting arm 178. The top end 178B of the second mounting arm 178 and mounting arm is property inserted into the first mounting arm. A fastener 182 may be inserted into those aligned openings 179 to secure them in place. In this particular view, only the opening 179 in the first mounting arm 176 is visible. In other embodiments, the first mounting arm 176 is fixedly connected together with the second mounting arm 178. A sleeve 180 is mounted to the bottom end 178A of the second mounting arm 178. The sleeve 180 is designed to be inserted over and to slide along the weight loading member 108, such that the height of the accessory 174 may be adjusted. Openings 184 formed in the sleeve 180 align with openings 186 formed in the weight loading member 108, and fasteners 188 may be inserted into the openings to fix the accessory 174 at a selected height.

Figures 2A, 2B:
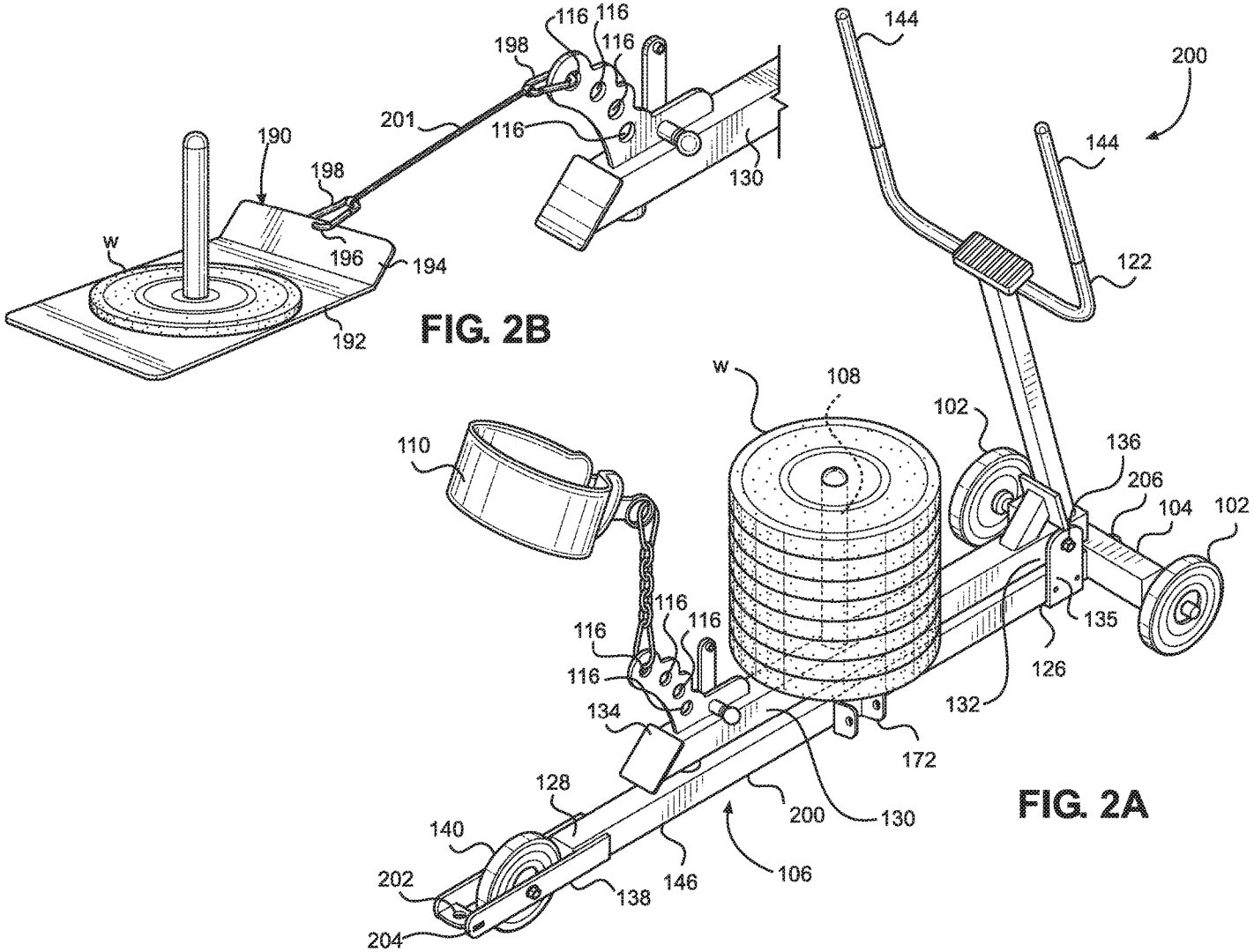
FIG. 2A is a perspective view of an exercise device according to a second embodiment of the present disclosure.
FIG. 2B is a perspective view of the device in FIG. 2A further including an option sled attachment.
Figure 3:
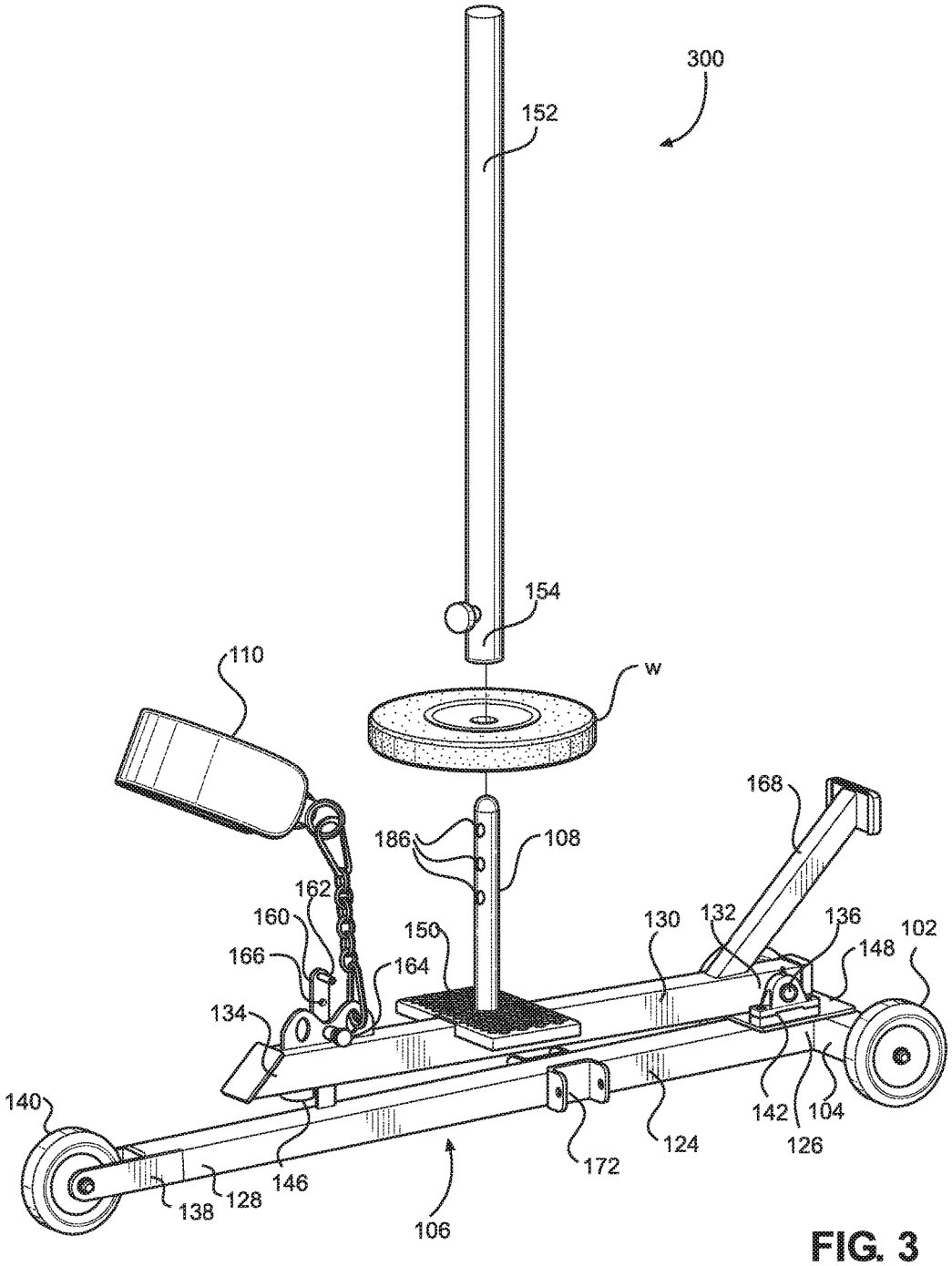
FIG. 3 is a perspective view of an exercise device according to a third embodiment of the present disclosure.
Figure 4A:
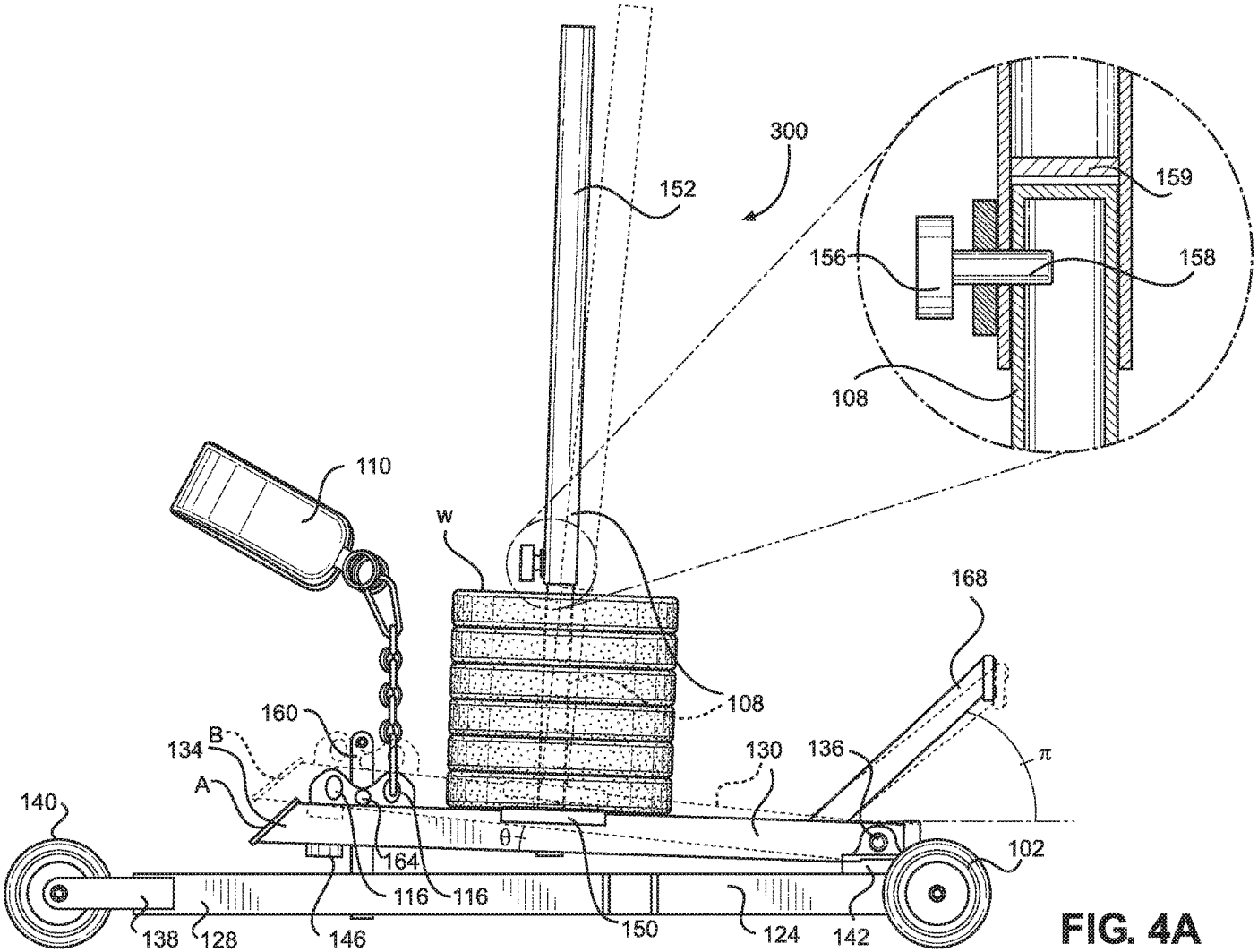
FIG. 4A is a side elevation view of the exercise device shown in FIG. 3, shown in a horizontal use position.
Figure 4B:
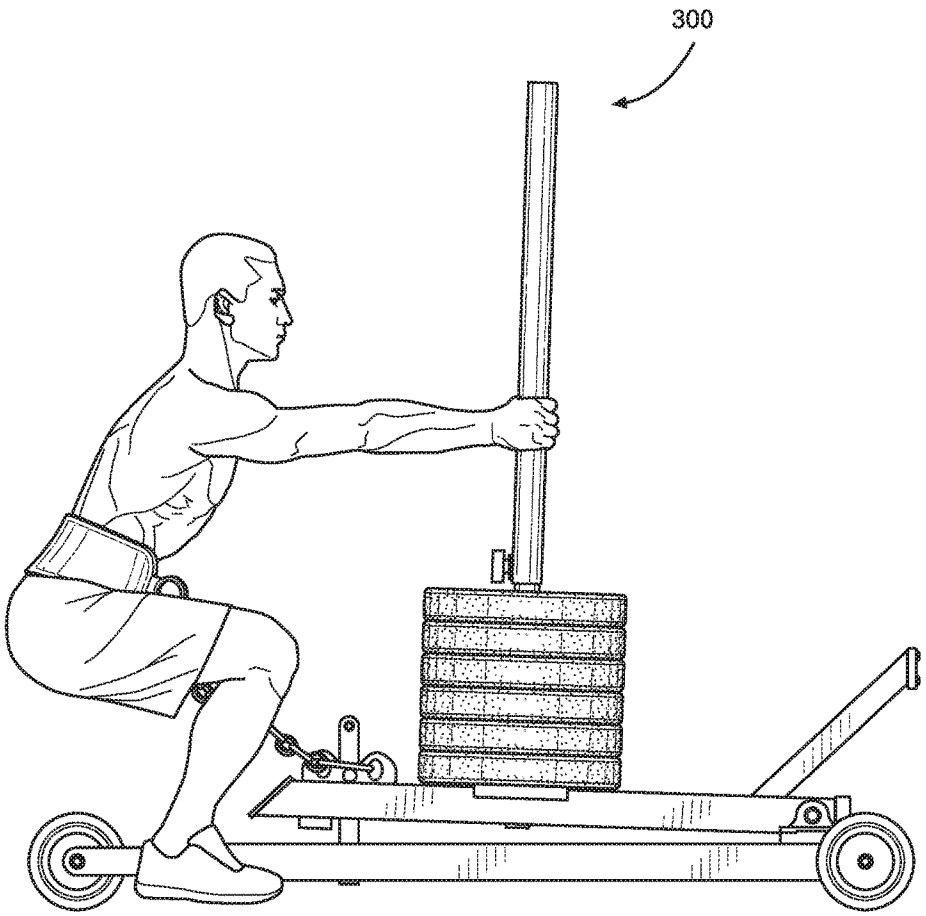
FIG. 4B is a side elevation view of the exercise device shown in FIG. 3, showing a user operating the device and the device in the down position A.
Figure 4C:
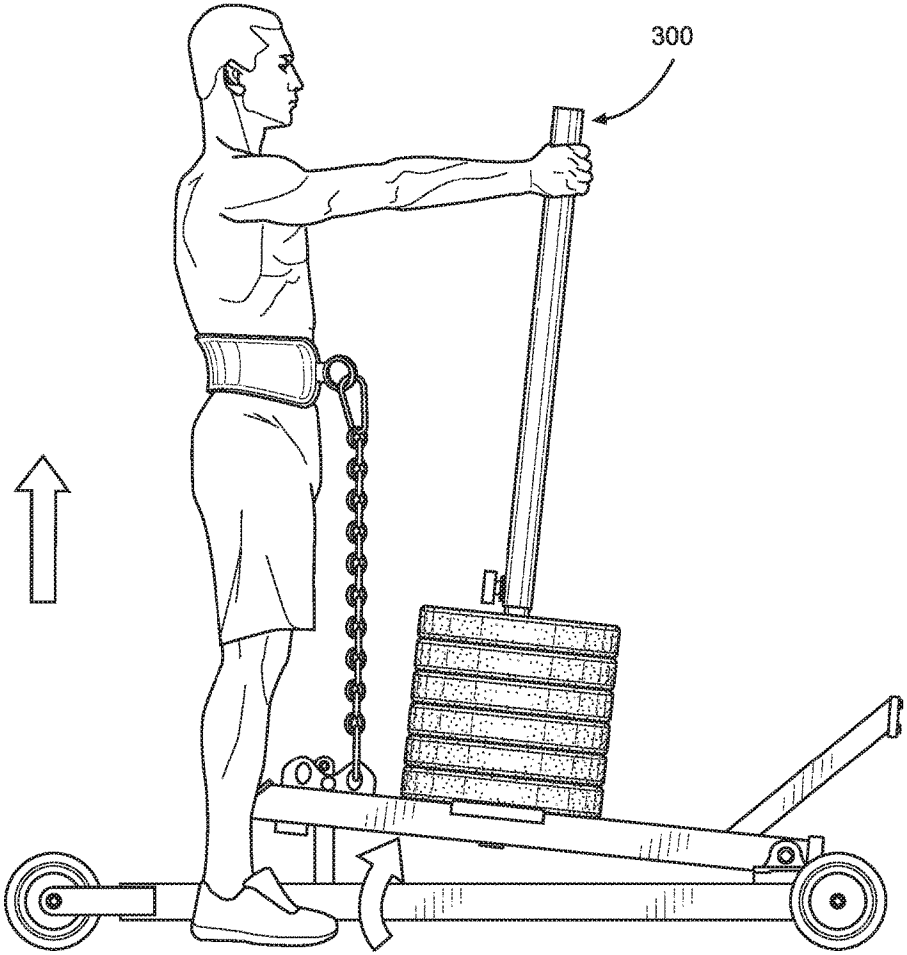
FIG. 4C is a side elevation view of the exercise device shown in FIG. 3, showing a user operating the device and the device in the up position B.
Figure 4D:
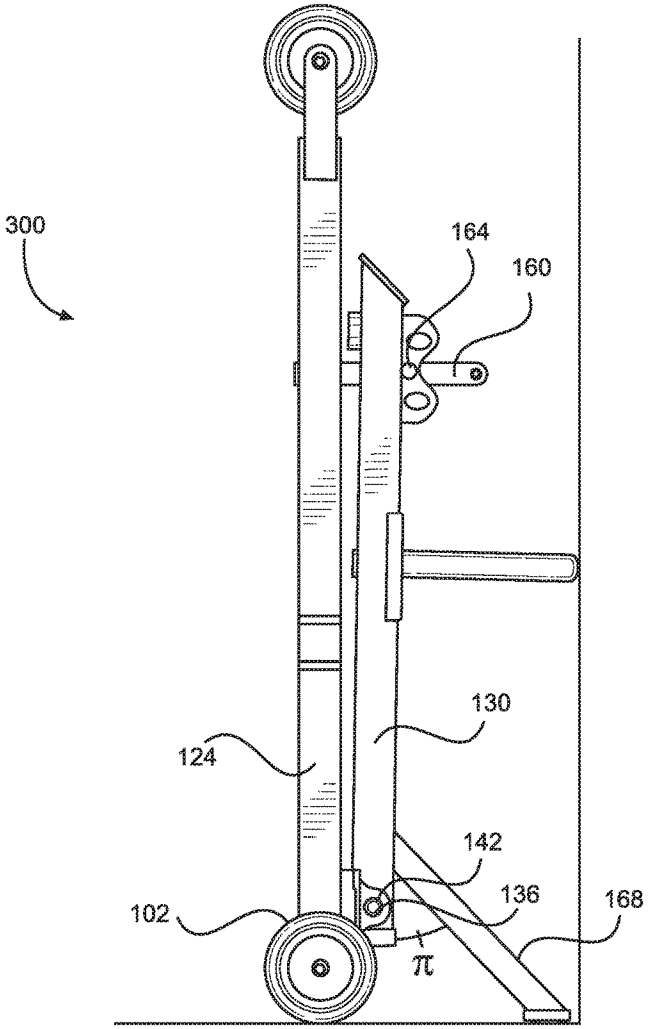
FIG. 4D is a side elevation view of the exercise device shown in FIG. 3, shown in a vertical storage position.

In FIG. 2A, an alternative mobile exercise device 200 is provided. In this embodiment, the weight carriage 106 includes an elongate stationary support 124 having a front end 126 and a back end 128. The front wheel mount 104 is mounted to the front end 126 of the stationary support 124. Likewise, a rear wheel mount 138 is connected to the back end 128 of the stationary support 124, and a rear wheel 140 is connected to the rear wheel mount. Thus, unlike the first embodiment discussed above where the second end 114 of the weight carriage 106 is raised off of the ground when the weights W are lifted, in this case the stationary support 124, front wheels 102, and rear wheel 140 form a stable support that remains in contact with the ground at all times.

An elongate rotatable support 130 includes a front end 132 and a back end 134. Weights W may be mounted to a weight loading member 108 that is mounted to and extends upwards from the rotatable support 130. Additionally, the hip strap 110 may be mounted to one of several mounting locations 116, which mounting locations arc upwards and rearwards from the rotatable support 130. A connection member or plate 135 rotatably connects the front end 126 of the stationary support 124 to the front end 132 of the rotatable support 130 to provide a center of rotation 136 about which the rotatable support rotates. As further described below, the stationary support 124 rotates between an up position when the weights are lifted off of the stationary support 124 by the user and a down position where the weight is resting on the stationary support. At the opposite end of the weight carriage 106, a bumper 146 is mounted to the bottom surface of the rotatable support 130 to prevent the back end 134 from directly contacting or damaging the stationary support 130 in the down position. Due to the bumper 146 and the plate 135, the rotatable support 130 and the weights W are vertically offset from the stationary support 124.

In use, the user connects one end of the hip belt 110 to the mobile exercise device 200 and places the other end around their waist. Using just the hip belt 110, the user can roll the device 200 and the weights W forwards or backwards on the front wheels 102 and back wheel 140. This may be accomplished while the rotatable support 130 is in either the up position or the down position. The user may also grasp the handlebar 122 to assist in moving the device 200 and raising the weights W or to steady themselves.

In FIG. 2B, an optional sled attachment 190 that may be used to connect additional weights W to the device 200 for added resistance is shown. The sled 190 includes a flat ground contact portion 192 that slides along the ground as the sled is pulled behind the device 200. A leading angled portion 194 is connected at an inclined angle to the flat portion 192. An opening 196 is formed in the angled portion 194. A connection strap 201 having connectors 198, such as carabiners, mounted at each end connects the sled 190 to the exercise device 300. One end of a carabiner 198 may be removably connected to the opening 196 formed in the angled portion 194 of the sled attachment 190. A second carabiner 198 located at the opposite end of the strap 201 may be mounted to one of the mounting locations 116. Alternatively, the carabiner 198 may be mounted to a front or rear opening located on the device 200. For example, a rear opening 202 is located on a rear bumper 204 that extends rearwards behind the rear wheel. A similar front opening 206 is formed on and extends away from the front wheel mount 104 between the front wheels 102.

In FIGS. 3 and 4A-4D, a third embodiment of a mobile exercise device 300 is provided. This device 300 is very similar to the device 200 discussed above and shown in FIG. 2A, so only the differences are discussed. First, a pillow block bearing 142 is mounted to the front end 126 of the stationary support 124 and functions as a connection member between the stationary support 124 and the rotatable support 130. The bearing 142 is rotatably connected together with the front end 132 of the rotatable support 130. Thus, the bearing provides the center of rotation 136 for this mobile exercise device 300. Preferably, a pair of bearings is provided on either side of the rotatable support 130. The bearings 142 may be mounted to a bearing support surface 148 that is mounted over the front wheel mount 104 and the stationary support 124.

Additionally, a weight support surface 150 may be mounted to the rotatable support 130 around the weight loading member 108. The weight support surface 150 contacts and supports exercise weights placed on the weight loading member 108. After weights have been loaded on to the weight loading member 108, a removable handle 152 may be placed over the weight loading member 108. The tip of the post-like weight loading member 108 is inserted into a lower opening 154 formed in its bottom. As shown best in FIG. 4A, a pull plunger 156 mounted to the handle 152 includes a pin 158 that passes through an opening in the side surface of the weight loading member 108 in order to removably connect the two together. Other removable connection means would also work. For example, as non-limiting examples, a threaded or friction-fit connection would also work. Additionally or alternatively, a bumper pad 159 may be fixedly placed within the handle 152. When the weight loading member 108 is inserted into the removable handle 152, the top end of the weight loading member contacts the bumper pad 159, which limits the insertion distance of the weight loading member into the handle. That insertion distance is great enough that the weight loading member 108 is retained within the handle 152, even a user grasps and applies a force to the handle. As discussed above, the user can grasp the handle 152 to assist in moving the device 300 and raising the weights W or to steady themselves.

The rotatable support 130 is rotatable about the connection member between a down position A and an up-position B. Position A is offset from Position B by an angle θ, which in this particular case, angle θ is approximately 10°. However, angle θ may vary from about 1° to about 45°, depending on the spacing between the center of rotation 136 and the mounting locations 116, where the rotatable support 130 is raised. An arm 160 extends upwards from the stationary support 130 and includes a stop 162 that extends laterally away from the arm. The stop 162 is configured to contact a portion of the rotatable when it is raised to the up position and to prevent the rotatable member from rotating beyond a selected position. In this particular embodiment, the stop 162 is long enough that it extends over a portion of the rotatable support 130 and contacts and top surface of the support in the up position.

Additionally, the device 300 may include a lock that secures the rotatable support 130 at a selected position and prevents rotation about the center of rotation 136. This may be useful, for example, when the device 300 is being stored or moved and no rotation of the rotatable support is desired. In this particular case, a plunger 164 (i.e., a first locking member) is mounted to the rotatable support 130. One or more apertures 166 (i.e., second locking members) are formed along the length of the arm 160, which engage with a pin of the plunger 164. Apertures 166 may be placed along the arm 160 in order to lock the rotatable support 130 at various positions or heights. Preferably, an aperture 166 is located such that the rotatable member 130 is prevented from rotating away from the down position (Position A) towards the up position (Position B) when the first locking member 164 and second locking member are engaged. In the embodiment shown, the stop 162 and the aperture 166 are shown on the same arm 160. However, in other embodiments, separate arms may be provided for the stop 162 and the aperture 166.

Figure 5B:
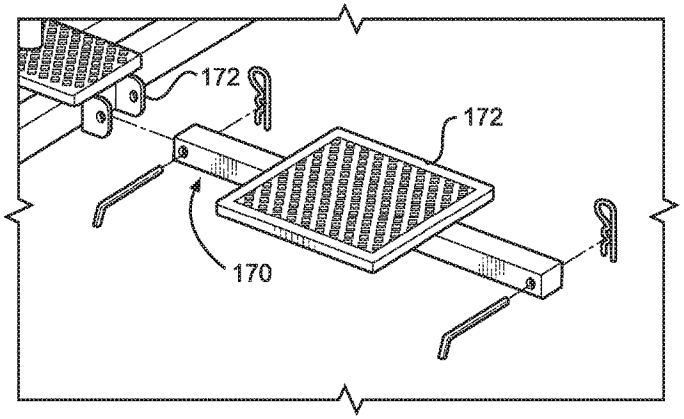
FIG. 5B depicts a connection member used for connecting the multiple exercise devices shown in FIG. 5A.
Figure 5A:
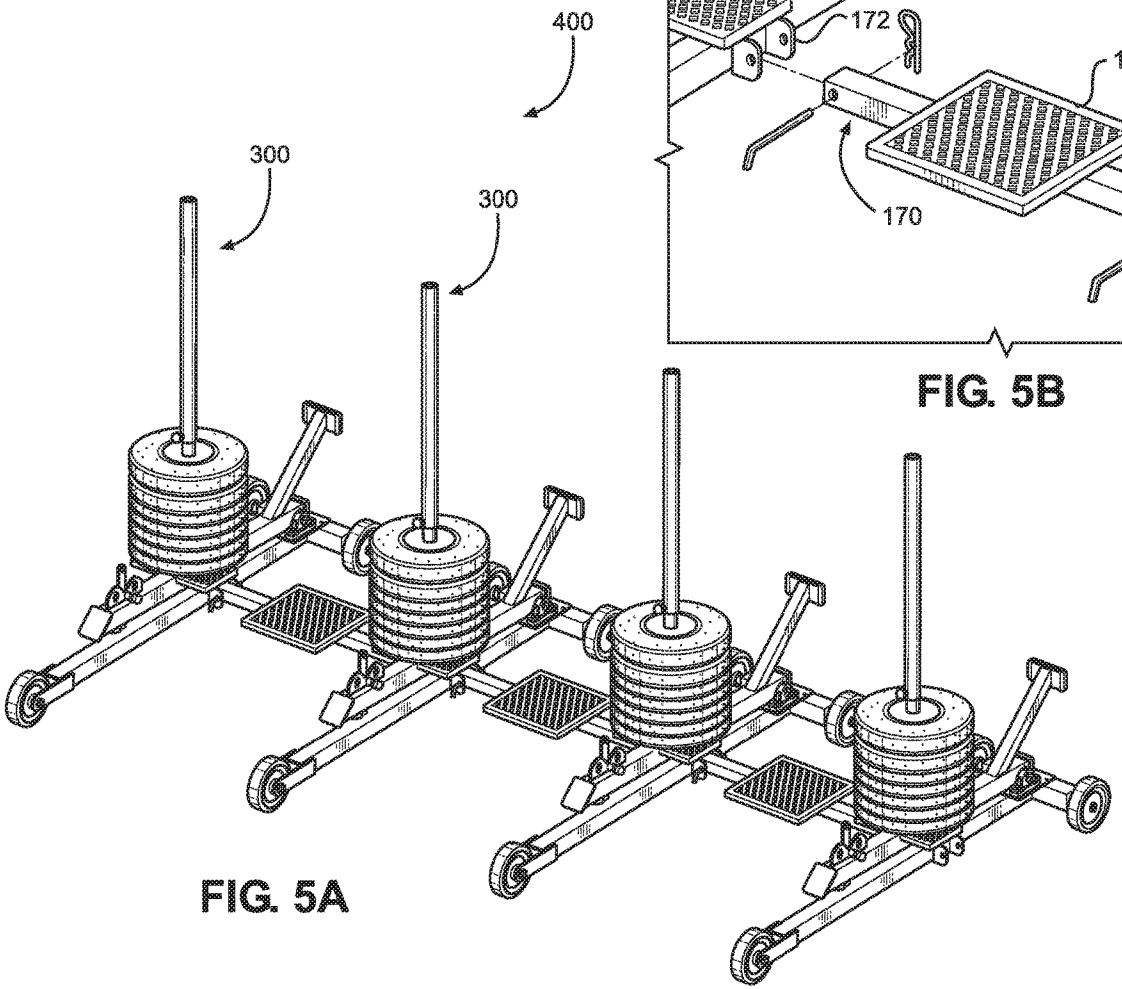
FIG. 5A depicts a system including multiple exercise devices connected together by a connection member.

The mobile exercise device 300 may be rotated over the front wheel 102 from a horizontal use orientation (FIG. 3) to an upright or storage position (FIG. 5) and then supported in the upright storage position by the front wheel and a leg 168. The leg 168 is mounted to and extends away from the elongate rotatable support 130 in a direction opposite the stationary support 124 and at an angle π with respect to the longitudinal axis of the rotatable support 130. In this particular case, angle π is about 45°. To store the device 300, the handle 152 and any weights are removed from the weight loading member 108. Next, the rotatable support 130 is locked into the down position by engaging the first and second locking members together. Lastly, the device 300 is rotated upwards until it is supported in a vertical position by the wheels 102 and the leg With reference now to FIGS. 5A and 5B, there is provided a system 400 of several mobile exercise devices 300 connected together and operating as a single unit. Using this system, several users can separately interact with their own individual exercise device 300, but the system as a whole moves as a unit. This configuration may be particularly use, for example, in training a team of athletes such as a football team. The individual exercise devices 300 are identical in structure as the one discussed previously and shown in FIG. 3. Adjacent exercise devices 300 can be joined together using a connection member 170 having ends that are rotatably mounted to the mounting brackets 172 and fixed therein with a pin connection. The connection member 170 maintains substantial front-to-back alignment between adjacent exercise devices 300. This enables connected exercise devices 300 to be moved forwards or backwards by users while ensuring that they remain at approximately the same position with respect to one another. Additionally, the connection member 170 allows for adjacent exercise devices 300 to be vertically movable with respect to one another. This is useful for allowing the devices to be moved over uneven terrain. Lastly, a user platform 172 may be provided on the connection member 170 to enable a third user, such as a coach, to be positioned between adjacent exercise devices. The platform 172 may, alternatively be a storage box for storing equipment, such as hip straps 110. In another alternative, the platform 172 may allow additional weights to be added to the system 400. Thus, a vertical post for receiving weights may be included on the platform 172.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A mobile exercise device comprising:

a front wheel;

a front wheel mount connected to the front wheel;

a weight carriage comprising:

an elongate stationary support having a front end and a back end, wherein the front wheel mount is disposed at the front end of the elongate stationary support;

an elongate rotatable support vertically offset from the elongate stationary support and having a front end and a back end;

a connection member rotatably connecting the front end of the elongate stationary support to the front end of the elongate rotatable support, wherein the elongate rotatable support is rotatable about the connection member between a down position and an up position;

a rear wheel mount connected to the back end of the elongate stationary support; and a rear wheel connected to the rear wheel mount;

a weight loading member mounted to the weight carriage operable to receive exercise weights and to support the exercise weights so that the exercise weights move as the weight carriage moves;

a user engagement member having a first end for engaging hips of a user and a second end for connecting to the weight carriage, wherein the second end of the user engagement member is connected to the back end of the elongate rotatable support for enabling the user to lift the back end of the elongate rotatable support, and wherein lifting the elongate rotatable support via the user engagement member causes the weight loading member to be lifted and to rotate with respect to the front wheel.

2. The exercise device of claim 1 further comprising an arm extending upwards from the elongate stationary support and having a stop, wherein the stop is configured to contact the elongate rotatable support when the elongate rotatable support is in the up position and to prevent the elongate rotatable support from rotating beyond the up position.

3. The exercise device of claim 1 further comprising:

a first locking member disposed on the elongate rotatable support; and a second locking member disposed on an arm extending upwards from the elongate stationary support, the second locking member configured to engage with the first locking member when the elongate rotatable support is in the down position such that the elongate rotatable support is prevented from rotating away from the down position towards the up position when the first and second locking members are engaged.

4. The exercise device of claim 1 further comprising a leg mounted to and extending away from the elongate rotatable support in a direction opposite the elongate stationary support, wherein the mobile exercise device is configured to rotate about the front wheel from a horizontal use orientation to an upright storage position and wherein the mobile exercise device is supported in the upright storage position by the front wheel and the leg.

5. The exercise device of claim 1 further comprising a pair of front wheels connected together in parallel arrangement by the front wheel mount.

6. The exercise device of claim 1 further comprising an accessory that is removably mounted to the weight carriage.

7. The exercise device of claim 6 wherein a removable handle is mounted to the weight loading member.

8. The exercise device of claim 1 further comprising forward and rearward mounting locations located on the weight carriage for removably connecting the second end of the user engagement member to the weight carriage, wherein the rearward mounting location is located between the forward mounting location and the second end of the weight carriage.

9. The exercise device of claim 1 further comprising a weight support surface mounted to the weight carriage proximate to the weight loading member and configured to contact and support the exercise weights by the weight loading member.

10. The exercise device of claim 1 wherein the user engagement member provides a single point connection between the user and the mobile exercise device that allows the user to lift the weight carriage.

11. A mobile exercise device system comprising:

two or more mobile exercise devices configured to removably mount together and to move forwards and backwards together as a unit when connected together, each mobile exercise device comprising:

a front wheel;

a front wheel mount connected to the front wheel;

a weight carriage having a first end and a second end, wherein the first end is mounted to and extends rearwardly from the front wheel mount, the weight carriage further comprising:

an elongate stationary support having a front end and a back end, wherein the front wheel mount is disposed at the front end of the elongate stationary support;

an elongate rotatable support vertically offset from the elongate stationary support and having a front end and a back end;

a connection member rotatably connecting the front end of the elongate stationary support to the front end of the elongate rotatable support, wherein the elongate rotatable support is rotatable about the connection member between a down position and an up position;

a rear wheel mount connected to the back end of the elongate stationary support; and a rear wheel connected to the rear wheel mount;

a weight loading member mounted to the weight carriage operable to receive exercise weights and to support the exercise weights so that the exercise weights move as the weight carriage moves;

a user engagement member having a first end for engaging hips of a user and a second end for connecting to the weight carriage; and a mounting bracket mounted to the elongate rotatable support;

a mounting bracket connection member having an end rotatably mounted to the mounting bracket of each adjacent pair of the two or more mobile exercise devices, wherein lifting the weight carriage via the user engagement member causes the weight loading member to be lifted and to rotate with respect to the front wheel, and wherein adjacent mobile exercise devices are kept in substantial front-to-back alignment with one another by the mounting bracket connection member being mounted to the mounting brackets and are vertically movable with respect to one another due to the rotatable mounting between the mounting bracket connection member and the mounting brackets.

12. The system of claim 11 further comprising an arm extending upwards from the elongate stationary support of each of the two or more mobile exercise devices, the arm having a stop that is configured to contact the elongate rotatable support when the elongate rotatable support is in the up position and to prevent the elongate rotatable support from rotating beyond the up position.

13. The system of claim 11 wherein each of the two or more mobile exercise devices further comprises:

an arm extending upwards from the elongate stationary support having a first locking member; and a second locking member disposed on the elongate rotatable support configured to engage with the first locking member when the elongate rotatable support is in the down position, wherein the elongate rotatable support is prevented from rotating away from the down position towards the up position when the first and second locking members are engaged.

14. The system of claim 11 wherein each of the two or more mobile exercise devices further comprises a leg mounted to and extending away from the elongate rotatable support in a direction opposite the elongate stationary support, wherein each of the two or more mobile exercise devices is configured to rotate about the front wheel from a horizontal use orientation to an upright storage position and wherein each of the two or more mobile exercise devices is supported in the upright storage position by the front wheel and the leg.

15. The exercise device of claim 11 wherein each of the two or more mobile exercise devices further comprises a pair of front wheels connected together in parallel arrangement by the front wheel mount.

16. The exercise device of claim 11 wherein each of the two or more mobile exercise devices further comprises a removable handle that is removably mounted to the weight carriage.

17. The exercise device of claim 16 wherein the removable handle is mounted to the weight loading member.

18. The exercise device of claim 11 wherein each of the two or more mobile exercise devices further comprises forward and rearward mounting locations located on the weight carriage for removably connecting the second end of the user engagement member to the weight carriage, wherein the rearward mounting location is located between the forward mounting location and the second end of the weight carriage.

19. The exercise device of claim 11 wherein each of the two or more mobile exercise devices further comprises a weight support surface mounted to the weight carriage proximate to the weight loading member and configured to contact and support the exercise weights by the weight loading member.

* * * * *